US007529511B2

(12) United States Patent
Kayahara et al.

(10) Patent No.: US 7,529,511 B2
(45) Date of Patent: May 5, 2009

(54) TONER CARTRIDGE

(75) Inventors: Yasufumi Kayahara, Saitama (JP); Takuji Matsumoto, Saitama (JP); Hiromitsu Koizumi, Saitama (JP); Chiharu Nakajima, Saitama (JP); Mutsumi Kikuchi, Saitama (JP); Toyohiko Awano, Saitama (JP); Shigeki Nishimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 11/603,836

(22) Filed: Nov. 24, 2006

(65) Prior Publication Data

US 2007/0253743 A1 Nov. 1, 2007

(30) Foreign Application Priority Data

Apr. 28, 2006 (JP) ..... 2006-126172

(51) Int. Cl.
*G03G 15/08* (2006.01)

(52) U.S. Cl. ..... 399/263; 399/258

(58) Field of Classification Search ..... 399/258, 399/262, 263
See application file for complete search history.

(56) References Cited

U.S. PATENT DOCUMENTS

| | | | | |
|---|---|---|---|---|
| 5,235,389 | A * | 8/1993 | Kikuchi et al. | 399/263 |
| 5,264,900 | A * | 11/1993 | Momiyama et al. | 399/263 X |
| 5,812,916 | A * | 9/1998 | Kishimoto et al. | 399/263 |
| 6,418,292 | B1 * | 7/2002 | Isobe et al. | 399/258 |
| 6,556,800 | B2 * | 4/2003 | Matsuda et al. | 399/258 |
| 7,248,823 | B2 * | 7/2007 | Buhay-Kettelkamp et al. | 399/263 X |
| 2005/0220498 | A1 * | 10/2005 | Ito | 399/262 |

FOREIGN PATENT DOCUMENTS

JP 11-024524 A 1/1999

* cited by examiner

*Primary Examiner*—Sandra L Brase
(74) *Attorney, Agent, or Firm*—Sughrue Mion, PLLC

(57) ABSTRACT

The present invention provides an exchangeable toner cartridge which can be attached to or detached from an apparatus main body. The toner cartridge includes the toner transfer member which is provided along a longitudinal direction of the toner cartridge and which can rotate. At the first range of the upstream side in a toner transfer direction the toner transfer member is formed into a substantially spiral shape, and at the second range of the downstream side in the toner transfer direction on a side of a toner supply port, toner transfer member has a shape different from that of the first range.

9 Claims, 11 Drawing Sheets

TONER CARTRIDGE

BACKGROUND

Technical Field

The present invention relates to a toner cartridge, and more particularly, to a toner cartridge of an image forming apparatus using an electrophotography system which develops an electrostatic image with toner.

Conventionally, in an image forming apparatus such as a copier and a laser printer employing the electrophotography system, it is required to reduce the number of exchanging times of consumable items to reduce page cost. For example, if a toner capacity in a toner cartridge, which supplies toner to the image forming apparatus, the frequency of exchanging operations of the cartridge, can be reduced.

In order to increase the maximum toner charging amount of the toner cartridge, it is possible to increase a surface area of a bottom surface of the toner cartridge, or when the toner cartridge is of a cylindrical shape, it is possible to increase a diameter of a cylindrical portion.

However, when the maximum toner charging amount of a toner cartridge which is attached to or detached to an existing image forming apparatus, it is impossible to increase the surface area of the bottom surface of the toner cartridge or to increase the diameter of the cylindrical portion. Even when the image forming apparatus is new one, in the case of a color copier which needs cartridges of four colors (YMCK), if the surface area of the bottom surface of the toner cartridge is increased or the diameter of the cylindrical portion is increased, the apparatus size is increased.

In order to increase the maximum toner charging amount, it seems possible to increase the toner capacity by making a portion of the toner cartridge in its longitudinal direction in a projecting form to increase its height.

However in the toner cartridge of such a shape, when toner is sent by a toner transfer member from a side of the toner cartridge where a cross-sectional area thereof in the longitudinal direction is large to a side of the toner cartridge where the cross-sectional area is small, toner is blocked, the rotation torque of the toner transfer member is increased, and there are fears that a gear is damaged and a motor burns.

SUMMARY

One aspect of the invention provides an exchangeable toner cartridge which can be attached to or detached from an apparatus main body. The toner cartridge includes the toner transfer member which is provided along a longitudinal direction of the toner cartridge and which can rotate. At the first range of the toner upstream side in a toner transfer direction the toner transfer member is formed into a substantially spiral shape, and at the second range of the downstream side in the toner transfer direction on a side of a toner supply port the toner transfer member has a shape different from that of the first range.

BRIEF DESCRIPTION OF THE DRAWINGS

Exemplary embodiments of the present invention will be described in detail based on the following figures, wherein.

DETAILED DESCRIPTION

<Basic Structure>

Figure 1:
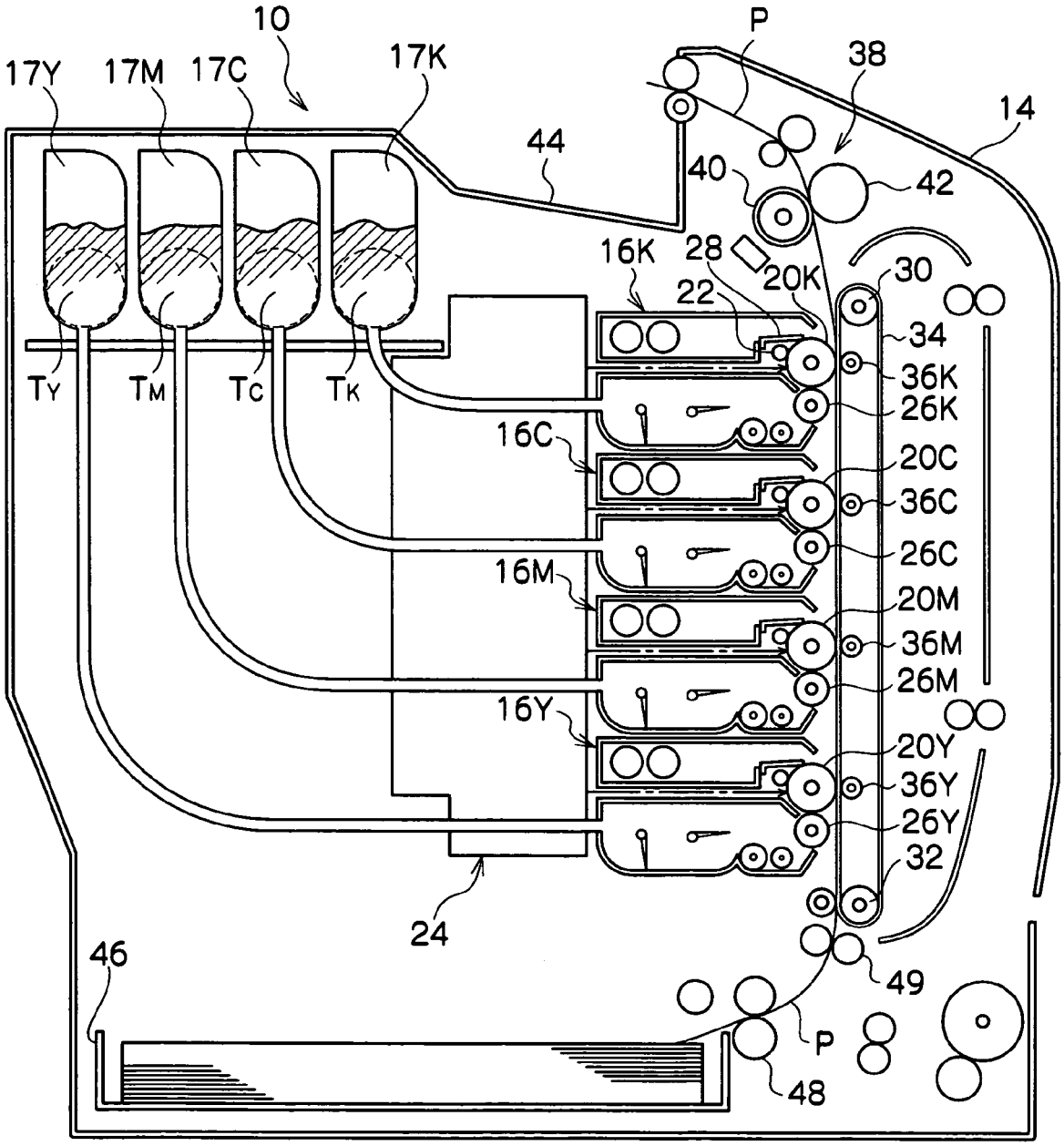
FIG. 1 is a schematic diagram showing an image forming apparatus according to the present invention.
Figure 2:
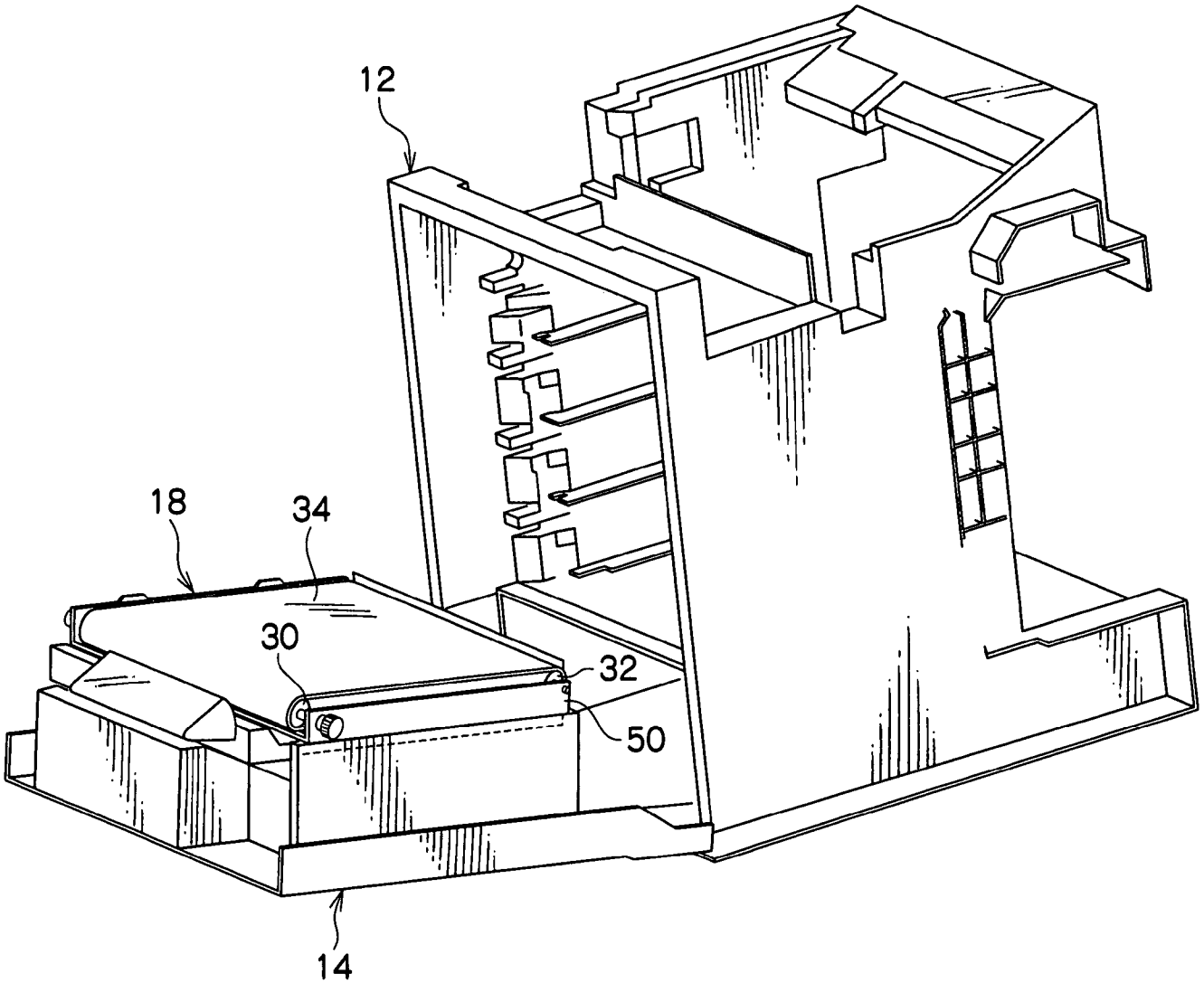
FIG. 2 is a perspective view showing the image forming apparatus of the present invention.

FIGS. 1 to 2 show a basic structure of an image forming apparatus of the present invention.

FIGS. 1 to 2 show an example of a four color image forming apparatus according to the present invention.

As shown in FIGS. 1 and 2, an image forming apparatus 10 includes a main body frame 12 in which image carriers (photosensitive bodies) 20 and developing units 16 are detachably accommodated, and a cover body 14 for opening and closing the image carriers 20 and the developing units 16. A transfer unit 18 having a transfer belt 34 is detachably mounted on the cover body 14. The transfer belt 34 can suction and transfer a recording sheet P.

Each of the developing units 16 includes a charged roller 22 for uniformly charging a surface of the roll-shaped image carrier 20, an optical box 24 which irradiates the image carrier 20 with image light based on image data and forms a latent image by a difference of electrostatic potentials, a developing roller 26 which selectively transfers toner to the latent image to make it visible, and a cleaning member 28 which comes into slidably contact with the image carrier 20 after the toner image is transferred to clean the toner remaining on the image carrier 20.

The image carrier 20 is provided at its surface (peripheral surface) with a photosensitive body layer. After the surface (peripheral surface) of the image carrier 20 is uniformly charged by the charged roller 22, the surface (peripheral surface) is exposed to laser light (image light) emitted from the optical box 24, the potential of the exposed portion is attenuated, thereby forming an electrostatic latent image (image). The charged roller 22 abuts against the image carrier 20, voltage is applied to therebetween, electricity is discharged in a fine gap near the abutment portion, and the surface of the image carrier 20 is substantially uniformly charged.

The optical box 24 allows flashing laser light to scan a surface (peripheral surface) of the image carrier 20, and forms an electrostatic latent image on the surface (peripheral surface) of the image carrier 20 based on the image data. As the optical box 24, luminous elements such as LEDs may be arranged and they are allowed to flash based on the image data.

The developing roller 26 is disposed close to the image carrier 20 such as to be opposed thereto, and developing bias voltage is applied to between the developing roller 26 and the image carrier 20. With this, a developing bias electric field is formed between the developing roller 26 and the image carrier 20, and toner having electric charge is transferred to the exposed portion on the image carrier 20 to form a visible image.

The transfer unit 18 includes a transfer belt 34 which is stretched around at least a drive roller 30 and a roller 32 which is rotated by the rotation of the drive roller 30. A plurality of (four corresponding to later-described colors) transfer rollers 36 are disposed at predetermined distances from one another at predetermined positions between the drive roller 30 and the roller 32 at the inner surface side the transfer belt 34.

When the cover body 14 is closed (when the cover body 14 is turned toward the main body frame 12 to close the image carrier 20 and the like), the transfer roller 36 is opposed to the image carrier 20 with the transfer belt 34 interposed therebetween. A transfer electric field is formed between the image carrier 20 and the cover body 14 so that a toner image (non-fixed image) on the surface of the image carrier 20 is transferred onto the recording sheet P which is suctioned and transferred by the transfer belt 34.

Here, the developing units 16 are disposed in the vertical direction in the order of yellow (Y), magenta (M), cyan (C), black (K) along the transfer direction of the recording sheet P from below so that full color printing can be carried out, and a fixing apparatus 38 is disposed on the downstream side in the transfer direction of the recording sheet P from the developing units 16Y to 16K.

The developing units 16Y to 16K develop electrostatic images on the image carriers 20Y to 20K by toner of yellow (Y), magenta (M), cyan (C), black (K), and transfers the formed toner image on the recording sheet P.

Since toner $T_Y$ to $T_K$ in the developing units 16Y to 16K are consumed by forming toner image, the processing is carried out while the amount of toner of colors in the developing units 16Y to 16K is maintained in a state where toner is appropriately supplemented from the toner cartridges 17Y to 17K.

The fixing apparatus 38 includes a heating roller 40 and a pressing roller 42 whose peripheral surfaces are opposed to each other and which are nipped under predetermined pressure. The heating roller 40 and the pressing roller 42 heat and press a non-fixed toner image transferred onto the recording sheet P, thereby fixing the toner image on the recording sheet P.

The recording sheet P which is heated and pressed by the fixing apparatus 38 (heating roller 40 and the pressing roller 42) is discharged on an output tray 44. After the toner image is transferred to the recording sheet P, a surface (peripheral surface) of the image carrier 20 is cleaned by the cleaning member 28 so that preparations for a next image forming processing can be made.

The main body frame 12 is provided at its lower portion with a detachable paper feed cassette 46. The paper feed cassette 46 can be pulled out in a direction opposite to a direction where the recording sheet P is sent out, and a recording sheet P can be appropriately supplied.

A pair of paper feed rollers 48 which sends out recording sheets P one-sheet by one-sheet from the paper feed cassette 46 is provided in the vicinity of a tip end of the paper feed cassette 46. The recording sheet P sent out from the pair of paper feed rollers 48 is sent out to a suction transfer surface of the transfer belt 34 at predetermined timing by a pair of resist rollers 49, and is transferred to a transfer position of each toner image of the corresponding color.

In the image forming apparatus 10 of the above-described structure, the transfer unit 18 detachably mounted on the cover body 14 will be explained in more detail.

The transfer unit 18 includes a substantially rectangular frame-shaped casing 50. The drive roller 30 is rotatably supported on one end (upper end) of the casing 50, and the roller 32 is rotatably supported on the other end (lower end). The transfer belt 34 capable of suctioning the recording sheet P statically is stretched around the drive roller 30 and the roller 32.

The transfer rollers 36Y to 36K are disposed at predetermined distances from one another based on colors between the drive roller 30 and the roller 32 on the inner surface side of the transfer belt 34. The transfer rollers 36Y to 36K are rotatably supported by the casing 50. When the cover body 14 is closed, the transfer rollers 36Y to 36K can sandwich the transfer belt 34 and bring the transfer belt 34 into contact with the image carriers 20Y to 20K under predetermined pressure, and the transfer rollers 36Y to 36K rotate when the transfer belt 34 runs.

<Toner Cartridge>

FIGS. 3A to 5 show the toner cartridge of the image forming apparatus according to the present invention.

Figures 3A, 3B:
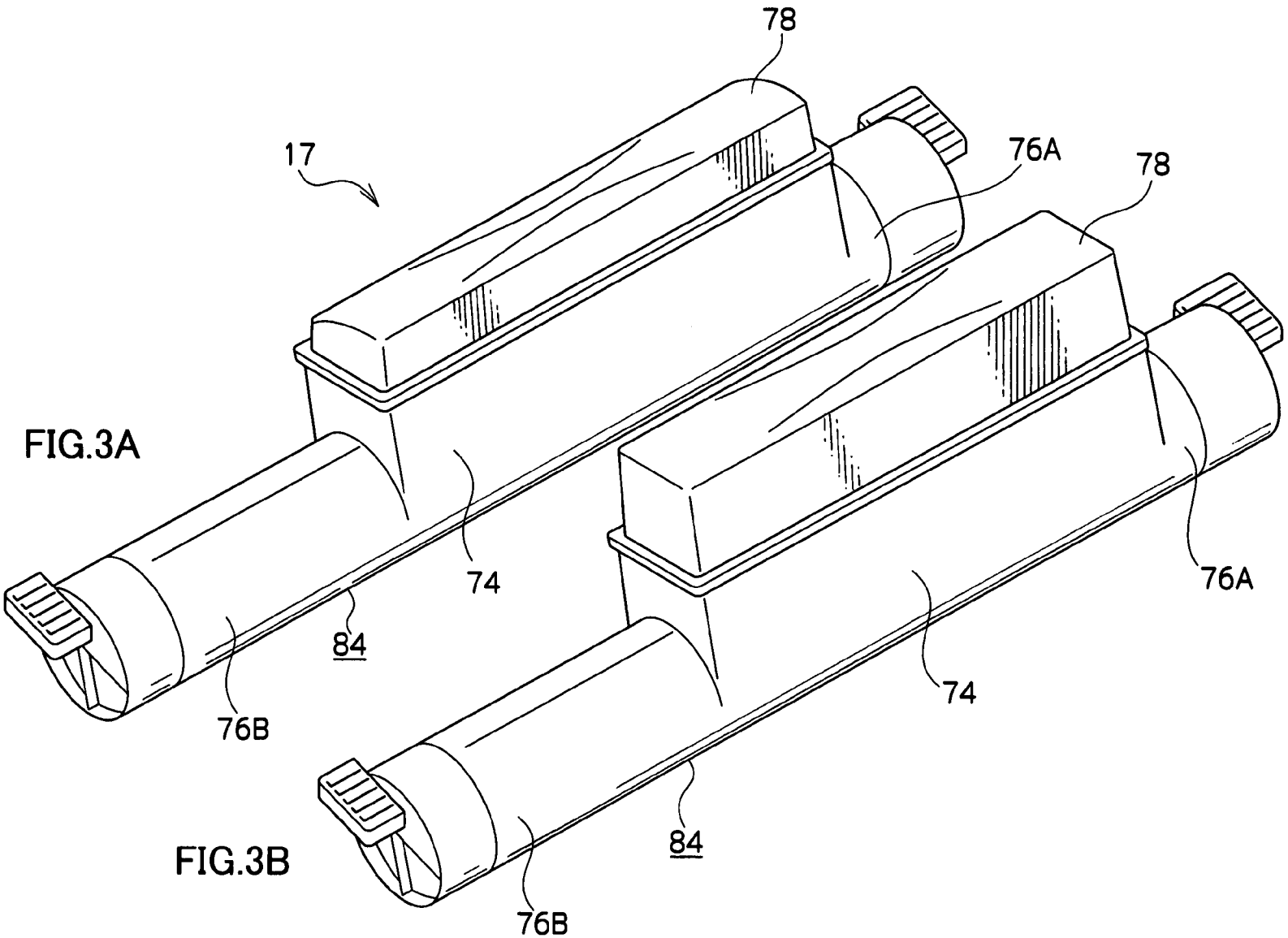
FIGS. 3A and 3B are perspective views showing a toner cartridge of the present invention.

The toner cartridge 17 of the present invention comprises three blocks, i.e., a central portion 74, and projections 76A and 76B as shown in FIGS. 3A and 3B. An upper portion of the central portion 74 has a substantially square shape. Lower portions of the cylindrical projections 76A and 76B and the central portion 74 are continuously integrally formed.

The central portion 74 is a space for accommodating toner T therein, the capacity of the central portion 74 is reduced for toner whose consuming amount is small as shown in FIG. 3A, and the capacity of the central portion 74 is increased for toner whose consuming amount is large as shown in FIG. 3B so as to cope with variation in toner capacity. At that time, if only a size of the cover body 78 constituting the upper portion of the central portion 74 is changed, other portions can be common. Therefore, it is possible to reduce cost while the capacity is secured.

Figure 4:
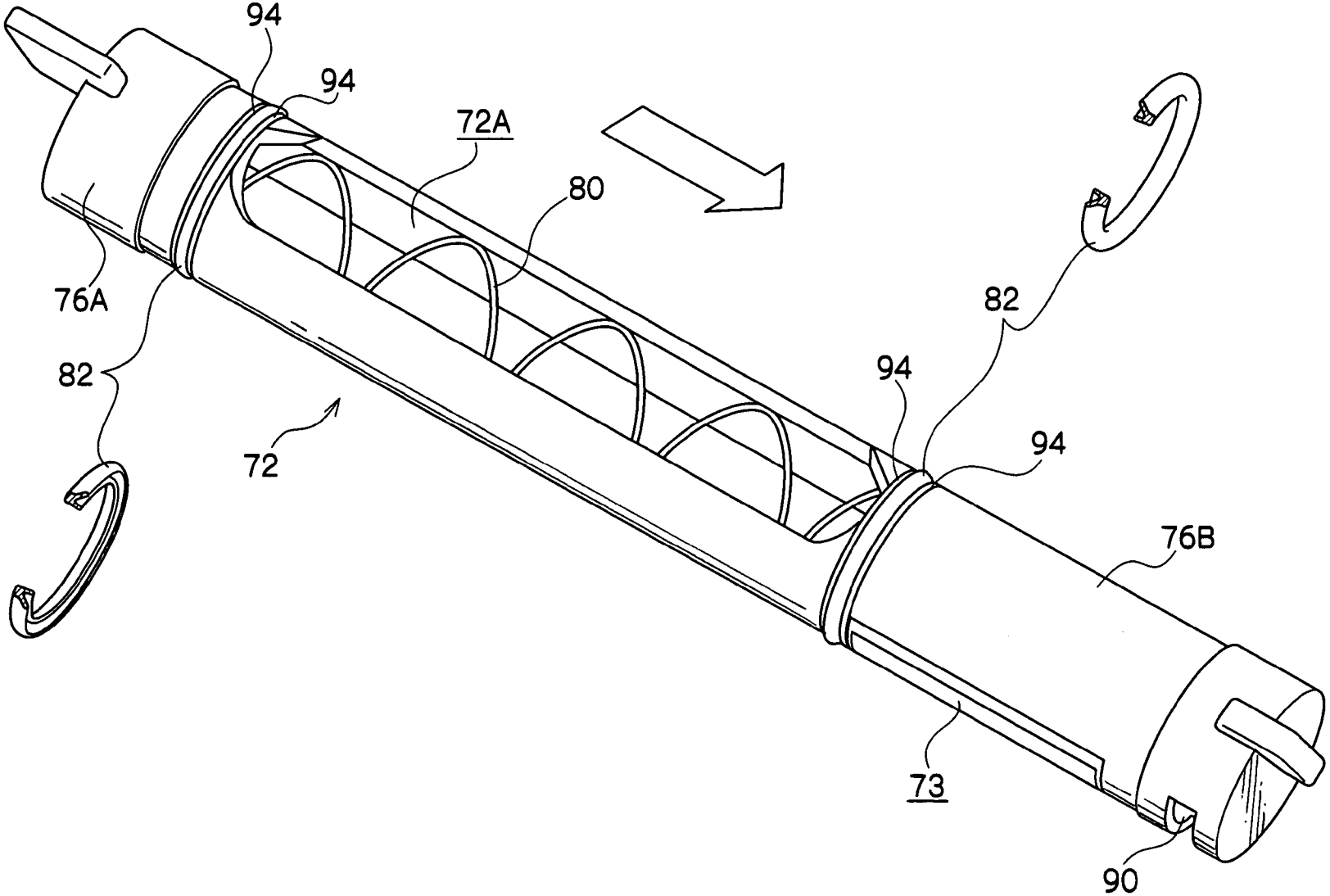
FIG. 4 is a perspective view showing an inner housing of the toner cartridge of the present invention.

FIG. 4 shows a structure of an inner housing 72 which is inserted into an outer housing 70 of the toner cartridge 17.

The toner cartridge 17 comprises the outer housing 70 and the substantially cylindrical inner housing 72 fitted into the outer housing 70. A spiral agitator 80 provided in the inner housing 72 turns the toner T in the central portion 74 by external power through a drive gear 90, thereby transferring the toner T toward a toner supply opening 84 provided in the outer housing 70.

Figure 5:
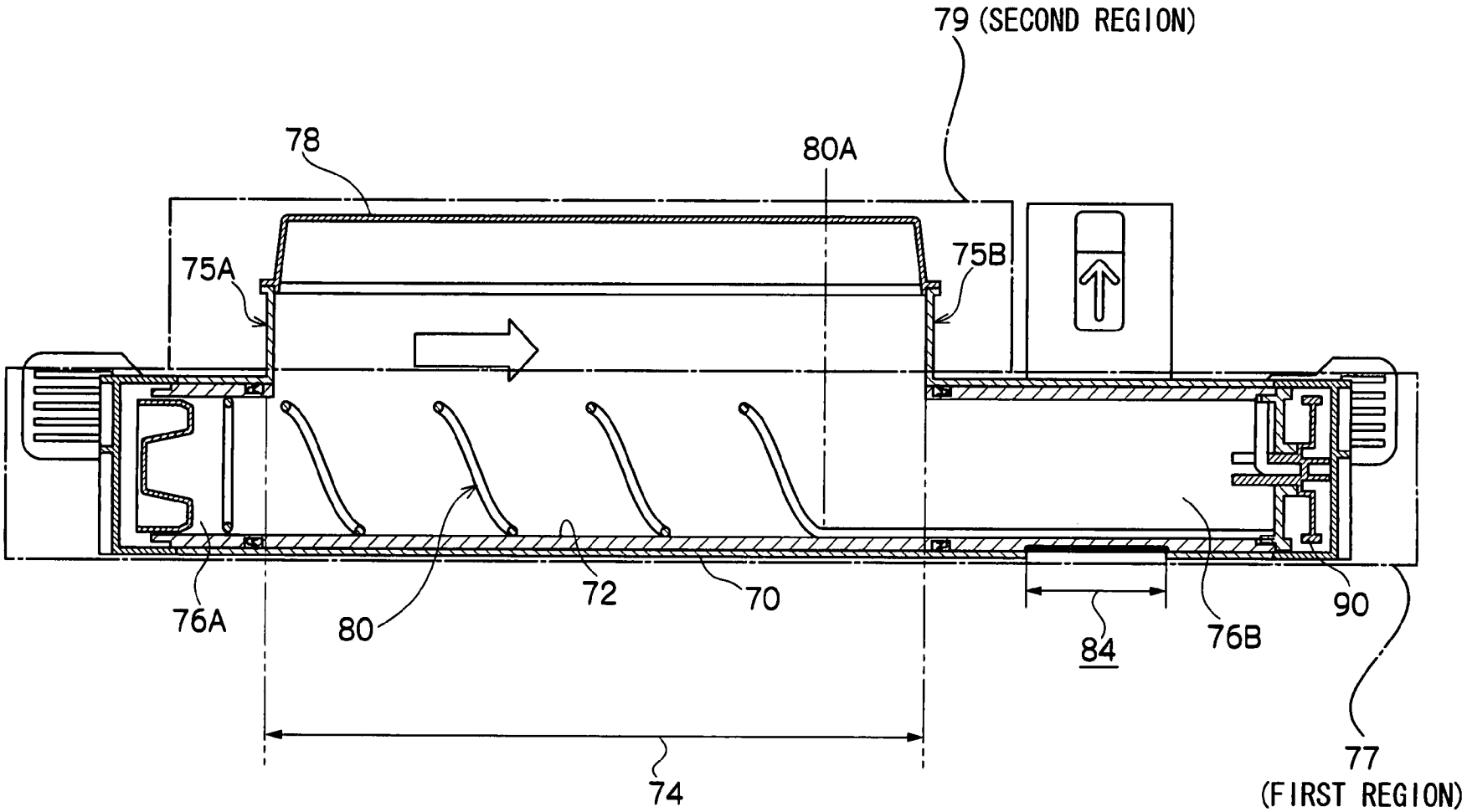
FIG. 5 is a sectional view showing an internal structure of the toner cartridge of the present invention.

As shown in FIG. 5, the toner cartridge 17 comprises a substantially cylindrical portion 77 (first region) which transfers and supplies toner T into the developing unit 16 of the image forming apparatus 10, and an extension portion 79 (second region) which is added securing the capacity of the toner cartridge 17 and for increasing toner T.

As shown in FIG. 4, the inner housing 72 is of substantially cylindrical shape. The inner housing 72 transfers toner T in the central portion 74 of the outer housing 70 from the opening 72A by the toner transfer direction (agitator 80, hereinafter), and transfers the toner T out from the toner supply opening 73. The position between the outer housing 70 and the inner housing 72 is determined by butting convex portions 94 provided on the inner housing 72 against a butting surface of an inner wall of the outer housing 70 at a position corresponding to a boundary wall 75 of the central portion 74 of the outer housing 70.

There are two pairs of convex portions 94. A ring-shaped V-shaped seal member 82 is formed between each pair of convex portions 94. The V-shaped seal member 82 has V-shaped cross section, and the V-shaped seal member 82 prevents toner T from leaking outside. The V-shaped seal members 82 have the V-shaped cross sections. Opening sides of the V-shaped cross section are opposed to each other, and this can effectively prevent toner T from leaking out. Since the seal member is of the ring-shaped shape, a nip amount of seal can be secured equally over the entire circumference, and it is possible to reliably prevent toner T from leaking.

The agitator 80, which transfers the toner T, is driven by external power through a gear 90. The agitator 80 transfers toner T which dropped into the inner housing 72 from the opening 72A formed in substantially the entire region superposing on the central portion 74 in a direction shown with a white arrow in the figure, and supplies the toner T from the toner supply opening 73 to the apparatus main body through the toner supply opening 84 of the outer housing 70.

<Spiral Shape Changing Point>

FIG. 5 shows a longitudinal cross section structure of the inner housing 72 inserted into the outer housing 70 and the outer housing 70.

As shown in FIG. 5, the agitator 80 is located in the inner housing 72 and stirs and transfers toner. The agitator 80 is of substantially spiral shape, however the spiral shape is changed at predetermined locations in the toner transfer direction (white arrow direction in the figure).

That is, the agitator 80 transfers toner T in the direction of the white arrow at the time of rotating, biasing and pressing the toner in the transfer direction by the spiral shape upstream in the toner transfer direction (left side in the figure), however the spiral shape is changed at a changing point 80A. With this, a toner transfer amount is reduced downstream in the transfer direction (right side in the figure).

More specifically, if the number of windings of the agitator 80 is reduced or the agitator 80 is formed into a straight shape and the number of windings is set to zero, the toner transfer amount per one rotation of the agitator 80 can be reduced.

Figure 6:
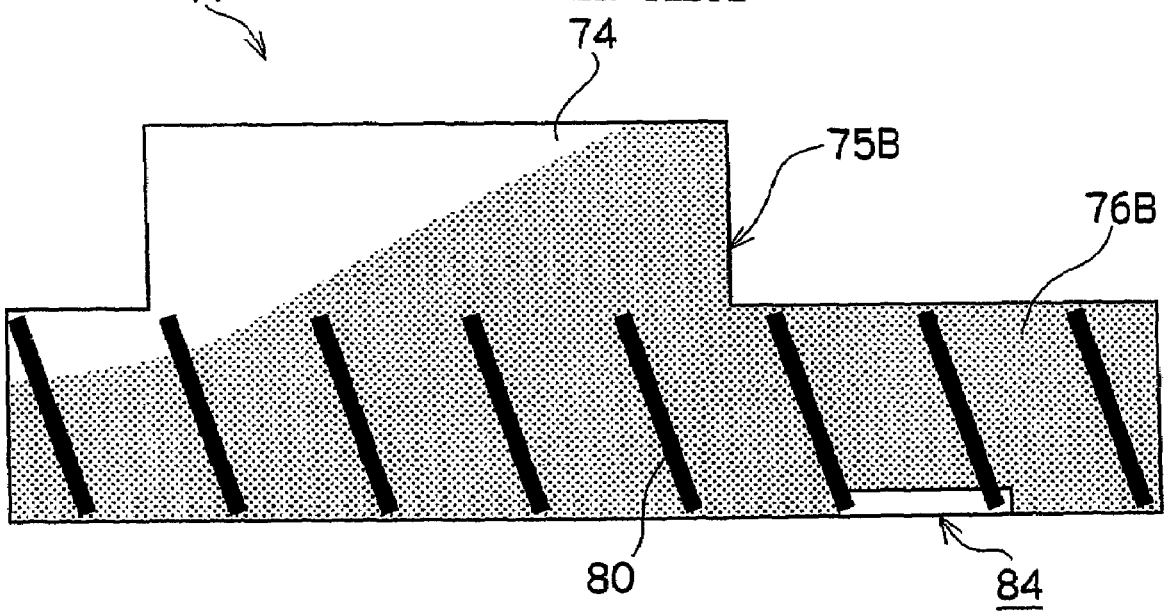
FIG.6 RELATED ART
FIG. 6 is a diagram of a toner transfer operation of a conventional toner cartridge.

If the spiral shape of the agitator 80 is one direction as shown in FIG. 6, toner T is transferred from the central portion 74 side where the cross-sectional area is greater to the projection 76B side where the cross-sectional area is smaller. At that time, toner is deposited near the boundary wall 75B where the cross-sectional area becomes smaller, and the blocking of the toner is generated.

Whereas, in the exemplary embodiment of the present invention, the spiral shape of the agitator 80 is changed at the predetermined location in the longitudinal direction, the toner transfer amount is reduced so that the amount of toner staying near the boundary wall 75B is reduced, and toner blocking can be avoided.

The spiral changing point 80A of the agitator 80 which transfers toner is on the upstream side in the transfer direction from the boundary wall 75B where the cross-sectional area becomes smaller in the toner transfer direction. With this, the toner transfer amount of downstream side from the boundary wall 75B can be reduced.

<Effect Obtained by Position of Spiral Shape Changing Point>

Figure 7:
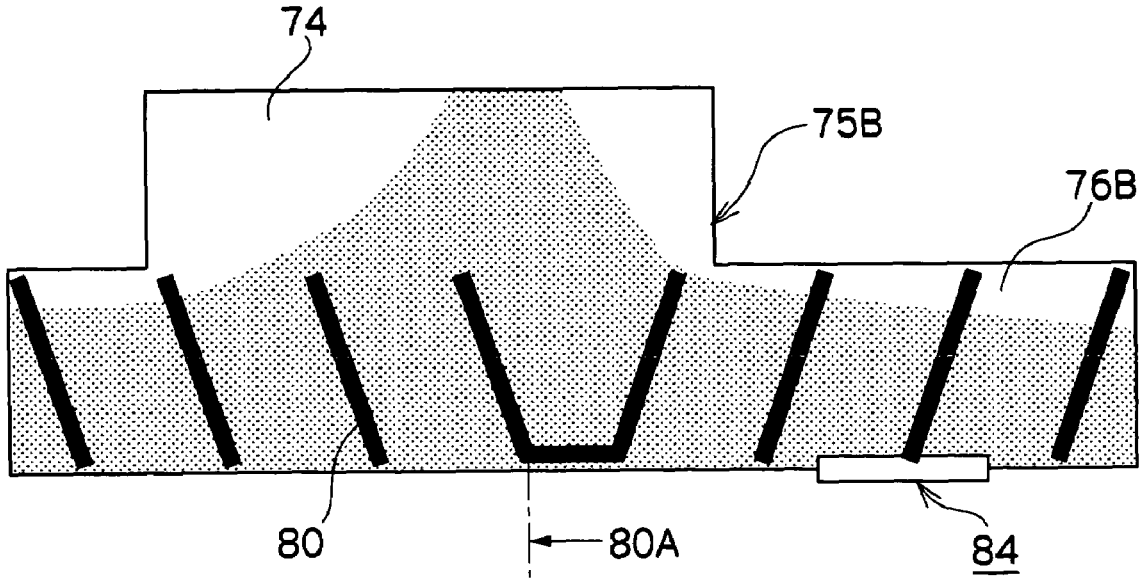
FIG. 7 is a diagram of a toner transfer operation of the toner cartridge of the present invention.
Figure 8:
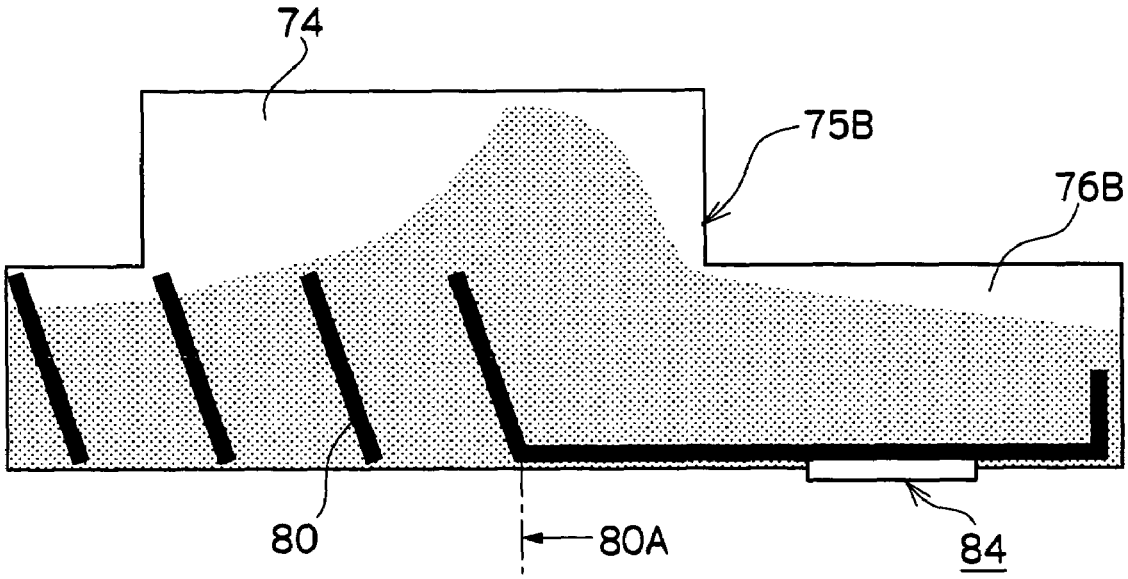
FIG. 8 is a diagram showing a toner transfer operation of a toner cartridge according to a second exemplary embodiment of the present invention.

As shown in FIGS. 7 and 8, the spiral changing point 80A of the agitator 80 which transfers toner is on the upstream side in the transfer direction from the boundary wall 75B where the cross-sectional area becomes smaller in the toner transfer direction. If the spiral changing point 80A is located at the further upstream side from the boundary wall 75B in the transfer direction, the blocking of toner can be prevented more reliably.

That is, if the spiral changing point 80A is located at the further upstream side (left side in the figure) from the boundary wall 75B in the transfer direction, the force pressing the toner on the boundary wall 75B becomes smaller and thus, the blocking of toner around the boundary wall 75B can be prevented more reliably also when the spiral direction becomes opposite after the changing point 80A with the straight portion interposed therebetween as shown in FIG. 7, or also when only the straight portion is formed after the changing point 80A without forming the spiral shape thereafter as shown in FIG. 8.

Figure 9:
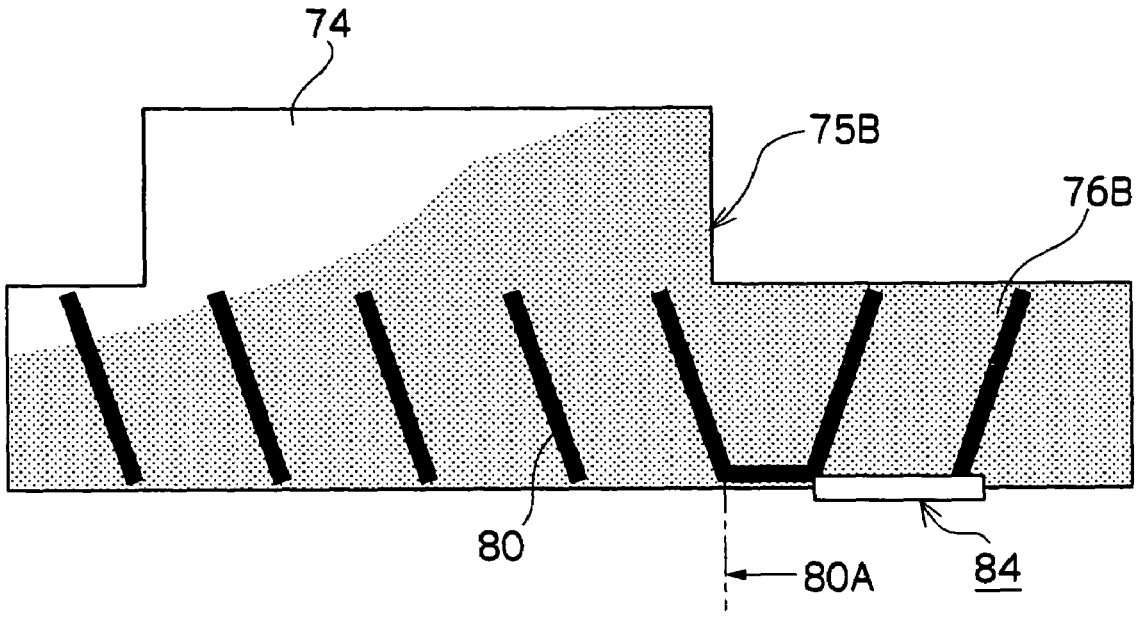
FIG. 9 is a diagram showing a toner transfer operation of a toner cartridge according to a modification of the present invention.
Figure 10:
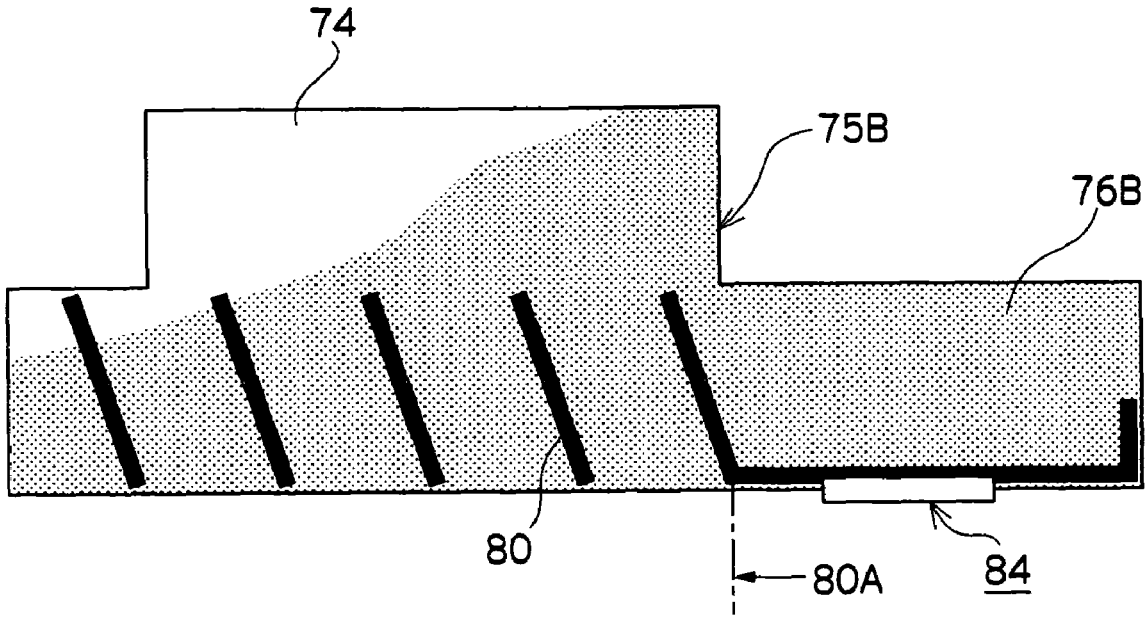
FIG. 10 is a diagram showing a toner transfer operation of a toner cartridge according to a modification of the second exemplary embodiment of the present invention.

On the other hand, if the position of the changing point 80A is located on the downstream side from the boundary wall 75B in the transfer direction as shown in FIGS. 9 and 10, the agitator 80 tries to transfer toner to a location downstream from the boundary wall 75B in the transfer direction where the cross-sectional area becomes smaller. As a result, toner is collected around the boundary wall 75B, the blocking of toner is prone to be generated in this area. Therefore, to prevent the blocking of toner, it is preferable that the changing point 80A is located on the upstream side from the boundary wall 75B in the transfer direction.

However, as the changing point 80A is located at the further upstream side in the transfer direction, the amount of toner remaining in the toner cartridge 17 is increased when no-toner signal is detected on the side of the image forming apparatus. That is, even when toner still remains in the toner cartridge 17, since the changing point 80A is located on the upstream side in the transfer direction, toner is not transferred to the toner supply opening 84 in the area downstream in the transfer direction, and toner is reversely transferred toward the upstream side in the transfer direction.

If sufficient toner remains in the toner cartridge 17, toner on the downstream side is pressed by toner on the upstream side in the transfer direction, and the former toner is pushed out into the toner supply opening 84, and if the toner is consumed and the remaining amount is reduced, toner on the downstream side is not transferred to the toner supply opening 84, no-toner signal is detected on the side of the image forming apparatus, and it is determined that no toner remains in the toner cartridge 17.

That is, even when toner still remains in the toner cartridge 17, no-toner signal is detected on the side of the image forming apparatus. Therefore, if a user exchanges the toner cartridge 17 at this time point, toner remaining in the toner cartridge 17 is not used and the toner cartridge 17 is dumped. Thus, a constant amount of toner is wasted and as a result, cost of the toner cartridge 17 is increased.

Whereas, if the spiral changing point 80A of the agitator 80 is located on the downstream side from the boundary wall 75B, the blocking of toner is prone to be generated as described above.

From this reason, to prevent the blocking of toner and to reduce the amount of remaining toner, it can be found that the most preferable position of the changing point 80A is near the boundary wall 75B and upstream therefrom in the transfer direction.

At that time, the agitator 80 may be driven from outside through a gear from the upstream side in the transfer direction (left side in the figure). The time when the agitator 80 is driven at the time of start of use of the toner cartridge 17 is time when the amount of toner inside is the greatest naturally, and the greatest torque is required for driving the agitator 80.

Figure 11:
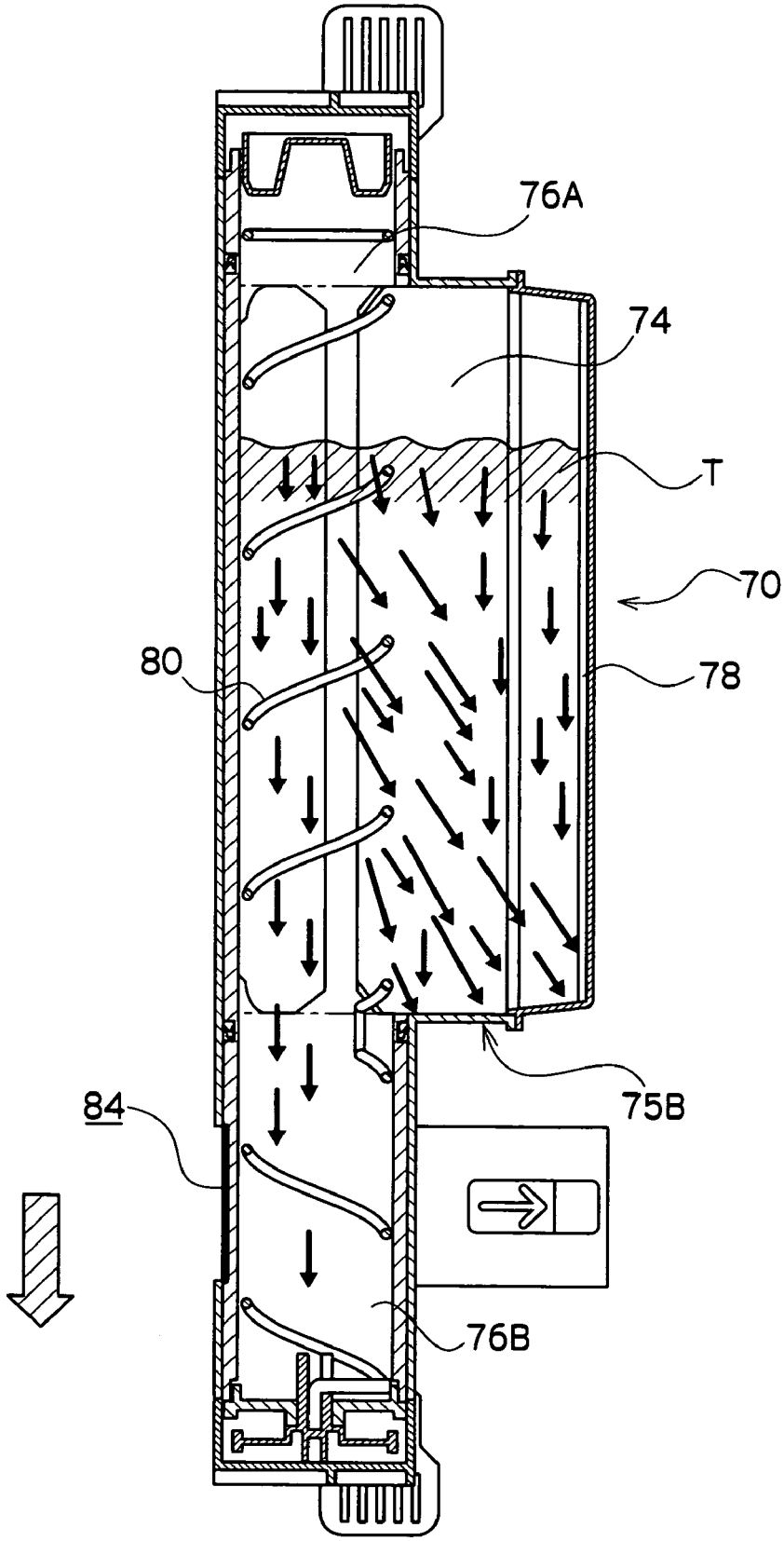
FIG. 11 is a sectional view showing toner movement in the toner cartridge of the present invention.

As shown in FIG. 11, when the toner cartridge 17 is transferred in a state where the downstream side thereof in the transfer direction (projection 76B) is directed downward, toner is prone to be agglutinated around the downstream projection 76B due to gravity, and high density toner is clogged. Here, if the agitator 80 is driven from the downstream projection 76B and the transfer of toner is started by turning motion of the agitator 80, the driving torque of the agitator 80 is high, and the gear 90 may be damaged.

On the contrary, if the gear 90 is provided on the upstream side (on the side of the projection 76A) and the agitator 80 is driven from the upstream projection 76A, it is possible to prevent the gear 90 from being damaged. When the toner cartridge 17 is transferred in a state where the downstream (projection 76B) side thereof in the transfer direction is oriented upward before start of use, toner is prone to be agglutinated around the upstream projection 76A due to gravity, and high density toner is clogged. In this case, if the transfer of toner is started by tuning the agitator 80, toner moves in a direction where toner is discharged out from the projection 76A. Therefore, it is possible to reduce the load (driving torque) applied to the gear 90 as compared with a case where the agitator 80 is driven from downstream (on the side of the projection 76B).

<Another Shape>

FIG. 8 shows a toner cartridge according to a second exemplary embodiment of the present invention.

If the spiral shape of the agitator 80 which transfers the toner is changed at the changing point 80A and the spiral direction is reversed from the straight portion as shown in FIG. 7, the toner transfer amount downstream from the boundary wall 75B can be reduced as described above.

In the exemplary embodiment of the present invention, as shown in FIG. 8, the spiral shape of the agitator 80 is not employed downstream from the changing point 80A in the transfer direction, and only the straight portion is formed, the reversed spiral shape is not employed on the downstream side, i.e., toner is not transferred in a direction opposite from the transfer direction, and the blocking of toner near the boundary wall 75B can be prevented.

That is, the agitator 80 does not transfer the toner downstream from the changing point 80A, however since there is only the straight portion, the toner is stirred, toner is transferred to the toner supply opening 84 sequentially by toner pressed by the upstream spiral portion. With this, toner is not concentrated near the boundary wall 75B, and the blocking of toner can effectively be prevented.

At that time, if the straight portion of the agitator 80 is provided at a position where it turns along an inner wall of the inner housing 72, the straight portion of the agitator 80 scrapes off toner adhering to the inner wall and thus, toner is effectively used and the amount of remaining toner can be reduced.

<Others>

The present invention is not limited to the exemplary embodiment.

For example, although the toner cartridge is for electrophotography in the exemplary embodiment, the present invention is not limited to this, and the present invention can be applied to other type product only if fine powder is transferred out from a storing container.

What is claimed is:

1. An exchangeable toner cartridge which can be attached to or detached from an apparatus main body, the toner cartridge comprising:

a toner transfer member which is provided along a longitudinal direction of the toner cartridge and which can rotate, wherein the toner transfer member in a first range on an upstream side in a toner transfer direction is formed into a substantially spiral shape, the toner transfer member in a second range on a side of the toner supply opening downstream in the toner transfer direction has a shape different from the shape of the first range, wherein the toner cartridge comprises a cylindrical first region where the toner transfer member is disposed, and a second region disposed in a substantially central portion in the longitudinal direction except at an upstream side of the first region in the toner transfer direction and a downstream side in the toner transfer direction where the toner supply opening is provided.

2. The toner cartridge of claim 1, wherein a spiral winding direction of the second range of the toner transfer member is opposite from a spiral winding direction of the first range.

3. The toner cartridge of claim 1, wherein a portion of the toner transfer member between the first range and the second range is straight in shape.

4. The toner cartridge of claim 1, wherein the toner transfer member is straight in shape within the second range.

5. The toner cartridge of claim 4, wherein the straight portion of the toner transfer member is turned along vicinities of an inner wall of the first region.

6. The toner cartridge of claim 1, wherein the spiral shape of the toner transfer member is changed downstream in the toner transfer direction from a portion thereof corresponding to the second region.

7. The toner cartridge of claim 1, wherein the toner transfer member is driven from the upstream side in the toner transfer direction.

8. The toner cartridge of claim 1, wherein the shape of the toner transfer member changes in a portion of the cylindrical first region disposed adjacent to the second region.

9. The toner cartridge of claim 8, wherein the shape of the toner transfer member changes from the substantially spiral member in the first range to a substantially straight member in the second range.

* * * * *